US011680227B2

(12) United States Patent
Wang et al.

(10) Patent No.: US 11,680,227 B2
(45) Date of Patent: Jun. 20, 2023

(54) ANHYDROUS AUTODISH FORMULATION

(71) Applicants: Dow Global Technologies LLC, Midland, MI (US); Rohm and Haas Company, Collegeville, PA (US)

(72) Inventors: Lin Wang, Furlong, PA (US); Robin P. Ziebarth, Midland, MI (US); Matthew E. Belowich, Midland, MI (US); Scott Backer, Phoenixville, PA (US); Paul Mercando, Pennsburg, PA (US); Yiyong He, Midland, MI (US)

(73) Assignees: Dow Global Technologies LLC, Midland, MI (US); Rohm and Haas Company, Collegeville, PA (US)

( * ) Notice: Subject to any disclaimer, the term of this patent is extended or adjusted under 35 U.S.C. 154(b) by 0 days.

(21) Appl. No.: 17/896,503

(22) Filed: Aug. 26, 2022

(65) Prior Publication Data

US 2022/0403296 A1 Dec. 22, 2022

Related U.S. Application Data

(62) Division of application No. 17/049,169, filed as application No. PCT/US2019/031407 on May 9, 2019.

(60) Provisional application No. 62/675,250, filed on May 23, 2018.

(51) Int. Cl.

| | |
|---|---|
| ***C11D 1/72*** | (2006.01) |
| ***C11D 1/75*** | (2006.01) |
| ***C11D 3/33*** | (2006.01) |
| ***C11D 3/395*** | (2006.01) |
| ***C11D 3/22*** | (2006.01) |
| ***C11D 3/04*** | (2006.01) |
| ***C11D 3/10*** | (2006.01) |
| ***C11D 3/20*** | (2006.01) |
| ***C11D 3/30*** | (2006.01) |
| ***C11D 3/36*** | (2006.01) |
| ***C11D 3/386*** | (2006.01) |
| ***C11D 3/39*** | (2006.01) |
| ***C11D 11/00*** | (2006.01) |
| ***C11D 17/06*** | (2006.01) |
| ***C11D 1/722*** | (2006.01) |
| ***C11D 3/08*** | (2006.01) |

(52) U.S. Cl.

CPC ..... *C11D 3/223* (2013.01); *C11D 1/72* (2013.01); *C11D 1/722* (2013.01); *C11D 3/046* (2013.01); *C11D 3/08* (2013.01); *C11D 3/10* (2013.01); *C11D 3/2086* (2013.01); *C11D 3/22* (2013.01); *C11D 3/30* (2013.01); *C11D 3/33* (2013.01); *C11D 3/361* (2013.01); *C11D 3/386* (2013.01); *C11D 3/38609* (2013.01); *C11D 3/3902* (2013.01); *C11D 3/3907* (2013.01); *C11D 3/3942* (2013.01); *C11D 3/3951* (2013.01); *C11D 11/0035* (2013.01); *C11D 17/06* (2013.01); *C11D 17/065* (2013.01)

(58) Field of Classification Search

CPC .. C11D 1/72; C11D 1/722; C11D 3/08; C11D 3/10; C11D 3/22; C11D 3/33; C11D 3/361; C11D 3/386; C11D 3/3902; C11D 3/3907; C11D 17/06; C11D 17/065

USPC ..... 510/224, 226, 375, 477, 509, 511

See application file for complete search history.

(56) References Cited

U.S. PATENT DOCUMENTS

| | | | | |
|---|---|---|---|---|
| 4,025,450 | A | 5/1977 | Lamberti et al. | |
| 5,437,810 | A | 8/1995 | Ewbank et al. | |
| 5,565,556 | A | 10/1996 | Heinzman et al. | |
| 6,020,295 | A | 2/2000 | Harrison et al. | |
| 7,879,994 | B2 | 2/2011 | Buchanan et al. | |
| 2005/0075258 | A1 | 4/2005 | Kessler et al. | |
| 2006/0069001 | A1* | 3/2006 | Song | C11D 1/66 510/220 |
| 2007/0015674 | A1 | 1/2007 | Song et al. | |
| 2008/0020960 | A1* | 1/2008 | Smith | C11D 3/046 510/267 |
| 2008/0210263 | A1 | 9/2008 | Brunswick et al. | |
| 2011/0269660 | A1* | 11/2011 | Miralles | C11D 7/14 510/219 |

(Continued)

FOREIGN PATENT DOCUMENTS

| | | | |
|---|---|---|---|
| CA | 2313171 | A1 | 12/2000 |
| EP | 0542496 | A1 | 5/1993 |

(Continued)

*Primary Examiner* — Gregory R Delcotto

(74) *Attorney, Agent, or Firm* — Thomas S. Deibert

(57) ABSTRACT

A method of washing glassware is provided including: providing automatic dishwashing apparatus; providing soiled glassware; placing soiled glassware in automatic dishwashing apparatus; providing wash water; providing rinse water; selecting anhydrous mixed powder or mixed granule comprising: 2.5-5 wt % of oxidized maltodextrin, wherein oxidized maltodextrin has Degree of Oxidation of 0.4-1.7; 10-25 wt % of amino acid based builder; 20-75 wt % of additional builder, wherein additional builder includes at least one of sodium citrate, sodium carbonate and sodium percarbonate; 2.5-7.5 wt % of bleach activator; 0.5-10 wt % of nonionic surfactant; 0.5-1 wt % of phosphonate; 1-6 wt % of enzyme; 5-15 wt % of filler; and <1 wt % water; placing selected anhydrous mixed powder or mixed granule in automatic dishwashing apparatus; contacting selected anhydrous mixed powder or mixed granule with wash water to form combination; contacting soiled glassware with combination to provide treated glassware; and then contacting treated glassware with rinse water to provide cleaned glassware.

10 Claims, No Drawings

(56) References Cited

U.S. PATENT DOCUMENTS

| | | | | |
|---|---|---|---|---|
| 2015/0144782 | A1* | 5/2015 | Fogwill | H01J 49/0431<br>250/288 |
| 2016/0222324 | A1* | 8/2016 | Letzelter | C11D 3/3932 |

FOREIGN PATENT DOCUMENTS

| | | | | |
|---|---|---|---|---|
| EP | 0755944 | A2 | 1/1997 | |
| FR | 2767271 | A1 | 2/1999 | |
| WO | 2014019680 | A1 | 2/2014 | |
| WO | WO-2016009210 | A1 * | 1/2016 | A47L 15/46 |
| WO | 2016154668 | A1 | 10/2016 | |
| WO | 2016160740 | A1 | 10/2016 | |

* cited by examiner

ANHYDROUS AUTODISH FORMULATION

This application is a divisional of U.S. Non-Provisional patent application Ser. No. 17/049,169 filed Oct. 20, 2020, which is a National Stage Entry under 35 U.S.C. § 371 of International Application No. PCT/US2019/031407 filed May 9, 2019, which claims priority to U.S. Provisional Application Ser. No. 62/675,250 filed May 23, 2018.

The present invention relates to a method of washing glassware. In particular, the present invention relates to a method of washing glassware using an anhydrous mixed granule automatic dishwashing formulation, comprising 1 to 10 wt % of oxidized maltodextrin; 10 to 60 wt % of an amino acid based builder; 1 to 87.7 wt % of an additional builder selected from the group consisting of carbonate builders, citrate builders, silicate builders and mixtures thereof; a bleach activator; a surfactant; 0.1 to 7 wt % of a phosphonate; enzyme; 0 to 75 wt % of a filler; and <1 wt % water.

Automatic dishwashing compositions are generally recognized as a class of detergent compositions distinct from those used for fabric washing or water treatment. Automatic dishwashing compositions are expected by users to produce a spotless and film-free appearance on washed articles after a complete cleaning cycle.

Phosphate-free biodegradable automatic dishwashing compositions are increasingly desirable. Phosphate-free automatic dishwashing compositions typically rely on non-phosphate builders, such as salts of citrate, carbonate, silicate, disilicate, bicarbonate, aminocarboxylates and others to sequester calcium and magnesium from hard water, and upon drying, leave an insoluble visible deposited film.

Accordingly, there remains a need for anhydrous mixed powder or mixed granule compositions that are amenable to phosphate-free application in compositions including phosphonate while providing acceptable filming performance in use on glassware while also providing enhanced biodegradability.

The present invention provides a method of washing glassware, comprising: providing an automatic dishwashing apparatus; providing soiled glassware; placing the soiled glassware in the automatic dishwashing apparatus; providing a wash water; providing a rinse water; selecting an anhydrous mixed powder or mixed granule according to the present invention; placing the selected anhydrous mixed powder or mixed granule in the automatic dishwashing apparatus; contacting the selected anhydrous mixed powder or mixed granule with the wash water to form a combination; contacting the soiled glassware with the combination to provide a treated glassware; and then contacting the treated glassware with the rinse water to provide a cleaned glassware.

DETAILED DESCRIPTION

When incorporated in automatic dishwashing compositions (particularly phosphate-free automatic dishwashing compositions), the anhydrous mixed powder or mixed granule of the present invention as particularly described herein surprisingly provides desirable anti-filming performance on glasses while also offering desirable biodegradability.

Unless otherwise indicated, ratios, percentages, parts, and the like are by weight. Weight percentages (or wt %) in the composition are percentages of dry weight, i.e., excluding any water that may be present in the composition. Percentages of monomer units in the polymer are percentages of solids weight, i.e., excluding any water present in a polymer emulsion.

As used herein, unless otherwise indicated, the terms "weight average molecular weight" and "Mw" are used interchangeably to refer to the weight average molecular weight as measured in a conventional manner with gel permeation chromatography (GPC) and conventional standards, such as polyethylene glycol standards. GPC techniques are discussed in detail in Modern Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. Weight average molecular weights are reported herein in units of Daltons.

The term "phosphate-free" as used herein and in the appended claims means compositions containing ≤1 wt % (preferably, ≤0.5 wt %; more preferably, ≤0.2 wt %; still more preferably, ≤0.1 wt %; yet still more preferably, ≤0.01 wt %; most preferably, less than the detectable limit) of phosphate (measured as elemental phosphorus).

Maltodextrin has the following structure

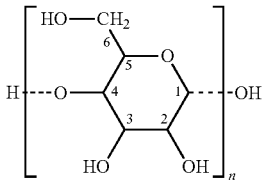

where n is an average of 2 to 20. The standard carbon site numberings 1 to 6 are shown in the structure. Oxidized maltodextrin is maltodextrin that has been modified such that a number of the C2 carbons, C3 carbons and C6 carbons have been oxidized to form carboxyl groups.

Preferably, the anhydrous mixed powder or mixed granule (preferably the anhydrous mixed granule; more preferably, an anhydrous mixed granule automatic dishwashing formulation), comprises: 1 to 10 wt % (preferably, 2 to 7.5 wt %; more preferably, 2.5 to 5 wt %; most preferably, 3 to 4 wt %) of an oxidized maltodextrin; 10 to 60 wt % (preferably, 10 to 50 wt %; more preferably, 10 to 25 wt %; most preferably, 10 to 15 wt %) of an amino acid based builder (preferably, methylglycinediacetic acid (MGDA)); 1 to 87.7 wt % (preferably, ≥1 wt %; more preferably, ≥10 wt %; yet more preferably, ≥20 wt %; most preferably, ≥25 wt %; preferably, ≤85 wt %; more preferably, ≤80 wt %; still more preferably, ≤75 wt %; most preferably, ≤70 wt %) of an additional builder selected from the group consisting of carbonate builders, citrate builders, silicate builders, amino acid derived builders and mixtures thereof (preferably, carbonate and citrate (i.e., mixture of at least one of sodium citrate, sodium carbonate, sodium percarbonate; more preferably, 20 wt % sodium citrate, 30 wt % sodium carbonate, 15 wt % sodium percarbonate); a bleach activator (preferably, TAED) (preferably, 1 to 10 wt %; more preferably, 2.5 to 7.5 wt %) of the bleach activator); a surfactant (preferably, a non-ionic surfactant; more preferably, Dowfax™ 20B102 surfactant) (preferably, 0.2 to 15 wt %; more preferably, 0.5 to 10 wt %; more preferably, 1.5 to 7.5 wt %) of the surfactant); 0.1 to 7 wt % (preferably, 0.25 to 5 wt %; more preferably, 0.45 to 2.5 wt %; most preferably, 0.5 to 1.0 wt %) of a phosphonate (preferably, HEDP); an enzyme; 0 to 75 wt % (preferably, 1 to 25 wt %; more preferably, 5 to 15 wt %; still more preferably, 7.5 to 12 wt %; most preferably, 8 to 10 wt %) of a filler; and <1 wt % water.

Preferably, the anhydrous mixed powder or mixed granule of the present invention comprises: an oxidized maltodextrin. Preferably, the anhydrous mixed powder or mixed granule of the present invention comprises: an oxidized maltodextrin; wherein the oxidized maltodextrin has a Degree of Oxidation, DO, of 0.4 to 1.7 (preferably, 0.45 to 1.5), as measured using quantitative $^{13}C$ NMR; wherein the Degree of Oxidation, DO, is the average number of hydroxyl groups in the oxidized maltodextrin at the C6, C3 and C2 positions that have been oxidized to carboxyl groups. Preferably, the anhydrous mixed powder or mixed granule of the present invention comprises: an oxidized maltodextrin; wherein the oxidized maltodextrin has a weight average molecular weight of 2,500 to 6,000 Daltons. Preferably, the anhydrous mixed powder or mixed granule of the present invention comprises: an oxidized maltodextrin; wherein at least 60 mol % of the C6 carbons in the oxidized maltodextrin have been oxidized to a carboxyl group. Preferably, the anhydrous mixed powder or mixed granule of the present invention comprises: an oxidized maltodextrin; wherein less than 30 mol % of the C2 and C3 carbons in the oxidized maltodextrin have been oxidized to a carboxyl group. Preferably, the anhydrous mixed powder or mixed granule of the present invention comprises: an oxidized maltodextrin; wherein the oxidized maltodextrin includes ≥0.0001 wt % (preferably, 0.0001 to 0.001 wt %) of at least one of 2,2,6,6-tetramethylpiperidinyloxy or 2,2,6,6-tetramethylpiperidine-1-oxyl). More preferably, the anhydrous mixed powder or mixed granule of the present invention comprises: an oxidized maltodextrin; wherein the oxidized maltodextrin has a Degree of Oxidation, DO, of 0.4 to 1.7 (preferably, 0.45 to 1.5), as measured using quantitative $^{13}C$ NMR; wherein the Degree of Oxidation, DO, is the average number of hydroxyl groups in the oxidized maltodextrin at the C6, C3 and C2 positions that have been oxidized to carboxyl groups. Still more preferably, the anhydrous mixed powder or mixed granule of the present invention comprises: an oxidized maltodextrin; wherein the oxidized maltodextrin has a Degree of Oxidation, DO, of 0.4 to 1.7 (preferably, 0.45 to 1.5), as measured using quantitative $^{13}C$ NMR; wherein the Degree of Oxidation, DO, is the average number of hydroxyl groups in the oxidized maltodextrin at the C6, C3 and C2 positions that have been oxidized to carboxyl groups and wherein the oxidized maltodextrin has a weight average molecular weight of 2,500 to 6,000 Daltons. Yet more preferably, the anhydrous mixed powder or mixed granule of the present invention comprises: an oxidized maltodextrin; wherein the oxidized maltodextrin has a Degree of Oxidation, DO, of 0.4 to 1.7 (preferably, 0.45 to 1.5), as measured using quantitative $^{13}C$ NMR; wherein the Degree of Oxidation, DO, is the average number of hydroxyl groups in the oxidized maltodextrin at the C6, C3 and C2 positions that have been oxidized to carboxyl groups; wherein the oxidized maltodextrin has a weight average molecular weight of 2,500 to 6,000 Daltons and wherein at least 60 mol % of the C6 carbons in the oxidized maltodextrin have been oxidized to a carboxyl group. Yet still more preferably, the anhydrous mixed powder or mixed granule of the present invention comprises: an oxidized maltodextrin; wherein the oxidized maltodextrin has a Degree of Oxidation, DO, of 0.4 to 1.7 (preferably, 0.45 to 1.5), as measured using quantitative $^{13}C$ NMR; wherein the Degree of Oxidation, DO, is the average number of hydroxyl groups in the oxidized maltodextrin at the C6, C3 and C2 positions that have been oxidized to carboxyl groups; wherein the oxidized maltodextrin has a weight average molecular weight of 2,500 to 6,000 Daltons; wherein at least 60 mol % of the C6 carbons in the oxidized maltodextrin have been oxidized to a carboxyl group and wherein less than 30 mol % of the C2 and C3 carbons in the oxidized maltodextrin have been oxidized to a carboxyl group. Most preferably, the anhydrous mixed powder or mixed granule of the present invention comprises: an oxidized maltodextrin; wherein the oxidized maltodextrin has a Degree of Oxidation, DO, of 0.4 to 1.7 (preferably, 0.45 to 1.5), as measured using quantitative $^{13}C$ NMR; wherein the Degree of Oxidation, DO, is the average number of hydroxyl groups in the oxidized maltodextrin at the C6, C3 and C2 positions that have been oxidized to carboxyl groups; wherein the oxidized maltodextrin has a weight average molecular weight of 2,500 to 6,000 Daltons; wherein at least 60 mol % of the C6 carbons in the oxidized maltodextrin have been oxidized to a carboxyl group; wherein less than 30 mol % of the C2 and C3 carbons in the oxidized maltodextrin have been oxidized to a carboxyl group and wherein the oxidized maltodextrin includes ≥0.0001 wt % (preferably, 0.0001 to 0.001 wt %) of at least one of 2,2,6,6-tetramethylpiperidinyloxy or 2,2,6,6-tetramethylpiperidine-1-oxyl).

Preferably, the anhydrous mixed powder or mixed granule of the present invention comprises: 1 to 10 wt % of an oxidized maltodextrin. More preferably, the anhydrous mixed powder or mixed granule of the present invention comprises: 2 to 7.5 wt % of an oxidized maltodextrin. Still more preferably, the anhydrous mixed powder or mixed granule of the present invention comprises: 2.5 to 5 wt % of an oxidized maltodextrin. Most preferably, the anhydrous mixed powder or mixed granule of the present invention comprises: 3 to 4 wt % of an oxidized maltodextrin.

Preferably, the anhydrous mixed powder or mixed granule of the present invention comprises: 10 to 60 wt % (preferably, 10 to 50 wt %; more preferably, 10 to 25 wt %; most preferably, 10 to 15 wt %) of an amino acid based builder. More preferably, the anhydrous mixed powder or mixed granule of the present invention comprises: 10 to 60 wt % (preferably, 10 to 50 wt %; more preferably, 10 to 25 wt %; most preferably, 10 to 15 wt %) of an amino acid based builder; wherein the amino acid based builder is selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-imonodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof. Yet more preferably, the anhydrous mixed powder or mixed granule of the present invention comprises: 10 to 60 wt % (preferably, 10 to 50 wt %; more preferably, 10 to 25 wt %; most preferably, 10 to 15 wt %) of an amino acid based builder; wherein the amino acid based builder includes at least one of methylglycinediacetic acid and a salt thereof. Most preferably, the anhydrous mixed powder or mixed granule of the present invention comprises: 10 to 60 wt % (preferably, 10 to 50 wt %; more preferably, 10 to 25 wt %; most preferably, 10 to 15 wt %) of an amino acid based builder; wherein the amino acid based builder is selected from the group consisting of methylglycinediacetic acid, salts thereof and mixtures thereof.

Preferably, the anhydrous mixed powder or mixed granule of the present invention comprises: 1 to 87.7 wt % (preferably, ≥1 wt %; more preferably, ≥10 wt %; yet more preferably, ≥20 wt %; most preferably, ≥25 wt %; preferably, ≤85 wt %; more preferably, ≤80 wt %; still more preferably, ≤75 wt %; most preferably, ≤70 wt %) of an additional builder. More preferably, the anhydrous mixed powder or mixed granule of the present invention comprises: 1 to 87.7 wt % (preferably, ≥1 wt %; more preferably, ≥10 wt %; yet more preferably, ≥20 wt %; most preferably, ≥25 wt %; preferably, ≤85 wt %; more preferably, ≤80 wt %; still more preferably, ≤75 wt %; most preferably, ≤70 wt %) of an additional builder; wherein the additional builder is selected from the group consisting of a carbonate builder, a citrate builder, a silicate builder and mixtures thereof. Still more preferably, preferably, the anhydrous mixed powder or mixed granule of the present invention comprises: 1 to 87.7 wt % (preferably, ≥1 wt %; more preferably, ≥10 wt %; yet more preferably, ≥20 wt %; most preferably, ≥25 wt %; preferably, ≤85 wt %; more preferably, ≤80 wt %; still more preferably, ≤75 wt %; most preferably, ≤70 wt %) of an additional builder; wherein the additional builder includes at least one of a carbonate builder and a citrate builder. Yet more preferably, preferably, the anhydrous mixed powder or mixed granule of the present invention comprises: 1 to 87.7 wt % (preferably, ≥1 wt %; more preferably, ≥10 wt %; yet more preferably, ≥20 wt %; most preferably, ≥25 wt %; preferably, ≤85 wt %; more preferably, ≤80 wt %; still more preferably, ≤75 wt %; most preferably, ≤70 wt %) of an additional builder; wherein the additional builder includes at least one of sodium citrate, sodium carbonate, sodium percarbonate. Most preferably, preferably, the anhydrous mixed powder or mixed granule of the present invention comprises: 1 to 87.7 wt % (preferably, ≥1 wt %; more preferably, ≥10 wt %; yet more preferably, ≥20 wt %; most preferably, ≥25 wt %; preferably, ≤85 wt %; more preferably, ≤80 wt %; still more preferably, ≤75 wt %; most preferably, ≤70 wt %) of an additional builder; wherein the additional builder includes a mixture of sodium citrate, sodium carbonate and sodium percarbonate. Weight percentages of carbonates, citrates and silicates are based on the actual weights of the salts, including metal ions.

The term "carbonate(s)" as used herein and in the appended claims refers to alkali metal or ammonium salts of carbonate, bicarbonate, percarbonate, and/or sesquicarbonate. Preferably, the carbonate used in the anhydrous mixed powder or mixed granule of the present invention (if any) is selected from the group consisting of carbonate salts of sodium, potassium and lithium (more preferably, salts of sodium or potassium; most preferably, salts of sodium). Percarbonate used in the anhydrous mixed powder or mixed granule of the present invention (if any) is selected from salts of sodium, potassium, lithium and ammonium (more preferably, salts of sodium or potassium; most preferably, salts of sodium). Most preferably, the carbonate used in the anhydrous mixed powder or mixed granule of the present invention (if any) is selected from the group consisting of sodium carbonate, sodium bicarbonate, sodium percarbonate and mixtures thereof.

The term "citrate(s)" as used herein and in the appended claims refers to alkali metal citrates. Preferably, the citrate used in the anhydrous mixed powder or mixed granule of the present invention (if any) is selected from the group consisting of citrate salts of sodium, potassium and lithium (more preferably, salts of sodium or potassium; most preferably, salts of sodium). More preferably, the citrate used in the anhydrous mixed powder or mixed granule of the present invention (if any) is sodium citrate.

The term "silicate(s)" as used herein and in the appended claims refers to alkali metal silicates. Preferably, the silicate used in the anhydrous mixed powder or mixed granule of the present invention (if any) is selected from the group consisting of silicate salts of sodium, potassium and lithium (more preferably, salts of sodium or potassium; most preferably, salts of sodium). More preferably, the silicate used in the anhydrous mixed powder or mixed granule of the present invention (if any) is sodium disilicate. Preferably, the additional builder used in the anhydrous mixed powder or mixed granule of the present invention includes a silicate. Preferably, when the additional builder used in the anhydrous mixed powder or mixed granule of the present invention includes a silicate, the anhydrous mixed powder or mixed granule preferably, comprises 0 to 10 wt % (preferably, 0.1 to 5 wt %; more preferably, 0.5 to 3 wt %; most preferably 0.75 to 2.5 wt %) of the silicate(s).

Preferably, the anhydrous mixed powder or mixed granule of the present invention comprises: a bleach activator. More preferably, the anhydrous mixed powder or mixed granule of the present invention comprises: a bleach activator, wherein the bleach activator includes tetraacetylethylenediamine (TAED). Most preferably, the anhydrous mixed powder or mixed granule of the present invention comprises: a bleach activator, wherein the bleach activator is tetraacetylethylenediamine (TAED).

Preferably, the anhydrous mixed powder or mixed granule of the present invention comprises: 1 to 10 wt % (preferably, 2.5 to 7.5 wt %) of a bleach activator. More preferably, the anhydrous mixed powder or mixed granule of the present invention comprises: 1 to 10 wt % (preferably, 2.5 to 7.5 wt %) of a bleach activator, wherein the bleach activator includes tetraacetylethylenediamine (TAED). Most preferably, the anhydrous mixed powder or mixed granule of the present invention comprises: 1 to 10 wt % (preferably, 2.5 to 7.5 wt %) of a bleach activator, wherein the bleach activator is tetraacetylethylenediamine (TAED).

Preferably, the anhydrous mixed powder or mixed granule of the present invention comprises: a surfactant. More preferably, the anhydrous mixed powder or mixed granule of the present invention comprises: 0.2 to 15 wt % (preferably, 0.5 to 10 wt %; more preferably, 1.5 to 7.5 wt %) of a surfactant. Still more preferably, the anhydrous mixed powder or mixed granule of the present invention comprises: 0.2 to 15 wt % (preferably, 0.5 to 10 wt %; more preferably, 1.5 to 7.5 wt %) of a surfactant, wherein the surfactant includes a nonionic surfactant. Most preferably, the anhydrous mixed powder or mixed granule of the present invention comprises: 0.2 to 15 wt % (preferably, 0.5 to 10 wt %; more preferably, 1.5 to 7.5 wt %) of a surfactant, wherein the surfactant includes a nonionic surfactant, wherein the nonionic surfactant is a fatty alcohol alkoxylate.

Preferably, the surfactant used in the anhydrous mixed powder or mixed granule of the present invention is a nonionic surfactant having a formula selected from $$RO\text{-}(M)_x\text{-}(N)_y\text{—}OH, \text{ and}$$

$$RO\text{-}(M)_x\text{-}(N)_y\text{—}(P)_z\text{—}OH$$

wherein M represents structural units of ethylene oxide, N represents structural units of $C_{3-18}$ 1,2-epoxyalkane, P represents structural units of $C_{6-18}$ alkyl glycidyl ether, x is 5 to 40, y is 0 to 20, z is 0 to 3 and R represents a $C_{6-22}$ linear or branched alkyl group.

Preferably, the surfactant used in the anhydrous mixed powder or mixed granule of the present invention is a nonionic surfactant having a formula selected from $$RO\text{-}(M)_x\text{-}(N)_y\text{—}OH, \text{ and}$$

$$RO\text{-}(M)_x\text{-}(N)_y\text{—}O\text{—}R'$$

wherein M and N are structural units derived from alkylene oxides (of which one is ethylene oxide); x is 5 to 40; y is 0 to 20; R represents a $C_{6-22}$ linear or branched alkyl group; and R' represents a group derived from the reaction of an alcohol precursor with a $C_{6-22}$ linear or branched alkyl halide, epoxyalkane or glycidyl ether.

Preferably, the surfactant used in the anhydrous mixed powder or mixed granule of the present invention is a nonionic surfactant having a formula $$RO\text{-}(M)_x\text{-}OH$$

wherein M represents structural units of ethylene oxide and x is at least three (preferably, at least five; preferably, no more than ten; more preferably, no more than eight). Preferably, wherein R and R' each have at least eight (more preferably, at least ten) carbon atoms.

Preferably, the anhydrous mixed powder or mixed granule of the present invention comprises: 0.1 to 7 wt % (preferably, 0.25 to 5 wt %; more preferably, 0.45 to 2.5 wt %; most preferably, 0.5 to 1.0 wt %) of a phosphonate. More preferably, the anhydrous mixed powder or mixed granule of the present invention comprises: 0.1 to 7 wt % (preferably, 0.25 to 5 wt %; more preferably, 0.45 to 2.5 wt %; most preferably, 0.5 to 1.0 wt %) of a phosphonate, wherein the phosphonate has a molecular weight of <1,000 Daltons. Still more preferably, the anhydrous mixed powder or mixed granule of the present invention comprises: 0.1 to 7 wt % (preferably, 0.25 to 5 wt %; more preferably, 0.45 to 2.5 wt %; most preferably, 0.5 to 1.0 wt %) of a phosphonate, wherein the phosphonate includes at least one of 1-hydroxy ethylidene-1,1-diphosphonic acid (HEDP) and salts thereof. Most preferably, the anhydrous mixed powder or mixed granule of the present invention comprises: 0.1 to 7 wt % (preferably, 0.25 to 5 wt %; more preferably, 0.45 to 2.5 wt %; most preferably, 0.5 to 1.0 wt %) of a phosphonate, wherein the phosphonate is selected from the group consisting of 1-hydroxy ethylidene-1,1-diphosphonic acid (HEDP), salts thereof and mixtures thereof.

Preferably, the anhydrous mixed powder or mixed granule of the present invention comprises: an enzyme. More preferably, the anhydrous mixed powder or mixed granule of the present invention comprises: an enzyme, wherein the enzyme is selected from the group consisting of a protease, an amylase, lipase, cellulase and mixtures thereof. Still more preferably, the anhydrous mixed powder or mixed granule of the present invention comprises: an enzyme, wherein the enzyme is selected from the group consisting of a protease, an amylase and mixtures thereof. Most preferably, the anhydrous mixed powder or mixed granule of the present invention comprises: an enzyme, wherein the enzyme includes a mixture of a protease and an amylase.

Preferably, the anhydrous mixed powder or mixed granule of the present invention comprises: 1 to 6 wt % (preferably, 2 to 4 wt %) of an enzyme. More preferably, the anhydrous mixed powder or mixed granule of the present invention comprises: 1 to 6 wt % (preferably, 2 to 4 wt %) of an enzyme, wherein the enzyme is selected from the group consisting of a protease, an amylase, lipase, cellulase and mixtures thereof. Still more preferably, the anhydrous mixed powder or mixed granule of the present invention comprises: 1 to 6 wt % (preferably, 2 to 4 wt %) of an enzyme, wherein the enzyme is selected from the group consisting of a protease, an amylase and mixtures thereof. Most preferably, the anhydrous mixed powder or mixed granule of the present invention comprises: 1 to 6 wt % (preferably, 2 to 4 wt %) of an enzyme, wherein the enzyme includes a mixture of a protease and an amylase.

Preferably, the anhydrous mixed powder or mixed granule of the present invention comprises: 0 to 75 wt % (preferably, 1 to 25 wt %; more preferably, 5 to 15 wt %; still more preferably, 7.5 to 12 wt %; most preferably, 8 to 10 wt %) (9 wt %) of a filler. More preferably, the anhydrous mixed powder or mixed granule of the present invention comprises: 0 to 75 wt % (preferably, 1 to 25 wt %; more preferably, 5 to 15 wt %; still more preferably, 7.5 to 12 wt %; most preferably, 8 to 10 wt %) of a filler; wherein the filler is selected from the group consisting of inert, water-soluble substances. Still more preferably, the anhydrous mixed powder or mixed granule of the present invention comprises: 0 to 75 wt % (preferably, 1 to 25 wt %; more preferably, 5 to 15 wt %; still more preferably, 7.5 to 12 wt %; most preferably, 8 to 10 wt %) of a filler; wherein the filler is selected from the group consisting of sodium sulfate, potassium sulfate, sodium chloride, potassium chloride and mixtures thereof. Yet still more preferably, the anhydrous mixed powder or mixed granule of the present invention comprises: 0 to 75 wt % (preferably, 1 to 25 wt %; more preferably, 5 to 15 wt %; still more preferably, 7.5 to 12 wt %; most preferably, 8 to 10 wt %) of a filler; wherein the filler includes sodium sulfate. Most preferably, the anhydrous mixed powder or mixed granule of the present invention comprises: 0 to 75 wt % (preferably, 1 to 25 wt %; more preferably, 5 to 15 wt %; still more preferably, 7.5 to 12 wt %; most preferably, 8 to 10 wt %) of a filler; wherein the filler is sodium sulfate.

Preferably, the anhydrous mixed powder or mixed granule of the present invention comprises: <1 wt % water. More preferably, the anhydrous mixed powder or mixed granule of the present invention comprises: <0.5 wt % water. Most preferably, the anhydrous mixed powder or mixed granule of the present invention comprises: <0.1 wt % water.

The anhydrous mixed powder or mixed granule of the present invention optionally further comprises an additive. Preferably, the anhydrous mixed powder or mixed granule of the present invention, further comprises: an additive selected from the group consisting of an alkaline source; a bleaching agent (e.g., sodium percarbonate, sodium perborate); a bleach catalyst (e.g., manganese(II) acetate, cobalt(II) chloride, bis(TACN)magnesium trioxide diacetate); a foam suppressant; a coloring agent; a fragrance; a silicate; an additional builder; an antibacterial agent; a filler; a deposit control polymer and mixtures thereof. More preferably, the anhydrous mixed powder or mixed granule of the present invention, further comprises an additive, wherein the additive includes a bleaching agent (e.g., sodium percarbonate, sodium perborate). Most preferably, the anhydrous mixed powder or mixed granule of the present invention, further comprises an additive, wherein the additive includes a bleaching agent, wherein the bleaching agent includes sodium percarbonate.

The anhydrous mixed powder or mixed granule of the present invention, optionally further comprises: an alkaline source. Suitable alkaline sources include, without limitation, alkali metal carbonates and alkali metal hydroxides, such as sodium or potassium carbonate, bicarbonate, sesquicarbonate, sodium, lithium, or potassium hydroxide, or mixtures of the foregoing. Sodium hydroxide is preferred. The amount of alkaline source in the anhydrous mixed powder or mixed granule of the present invention (if any) is at least 1 wt % (preferably, at least 20 wt %) and up to 80 wt % (preferably, up to 60 wt %).

The anhydrous mixed powder or mixed granule of the present invention, optionally further comprises: a bleaching agent (e.g., sodium percarbonate). The amount of the bleaching agent in the anhydrous mixed powder or mixed granule of the present invention (if any) is preferably at a concentration of 1 to 25 wt % (more preferably, 5 to 20 wt %).

The anhydrous mixed powder or mixed granule of the present invention, optionally further comprises: a deposit control polymer, useful for controlling insoluble deposits in automatic dishwashers. Preferable deposit control polymers include polymers comprising combinations of structural units of at least one of acrylic acid, methacrylic acid, diacid monomers (e.g., maleic acid), esters of acrylic or methacrylic acid (e.g., polyethylene glycol esters), styrene, sulfonated monomers (e.g., AMPS), substituted acrylamides and substituted methacrylamides.

Preferably, the anhydrous mixed powder or mixed granule of the present invention comprises ≤1 wt % (preferably, ≤0.5 wt %; more preferably, ≤0.2 wt %; still more preferably, ≤0.1 wt %; yet still more preferably, ≤0.01 wt %; most preferably, <the detectable limit) of phosphate (measured as elemental phosphorus). Preferably, the anhydrous mixed powder or mixed granule of the present invention is phosphate free.

Preferably, the anhydrous mixed powder or mixed granule of the present invention has a pH (at 1 wt % in water) of at least 9 (preferably, ≥10; more preferably, ≥11.5). Preferably, the anhydrous mixed powder or mixed granule of the present invention has a pH (at 1 wt % in water) of no greater than 13.

Preferably, the anhydrous mixed powder or mixed granule of the present invention is suitable for use under typical operating conditions. For example, when used in an automatic dishwashing machine, typical water temperatures during the washing process preferably are from 20° C. to 85° C., preferably 30° C. to 70° C.

Preferably, the method of washing glassware of the present invention, comprises: providing an automatic dishwashing apparatus; providing soiled glassware; placing the soiled glassware in the automatic dishwashing apparatus; providing a wash water; providing a rinse water; selecting an anhydrous mixed powder or mixed granule of the present invention; placing the selected anhydrous mixed powder or mixed granule in the automatic dishwashing apparatus; contacting the selected anhydrous mixed powder or mixed granule with the wash water to form a combination; contacting the soiled glassware with the combination to provide a treated glassware; and then contacting the treated glassware with the rinse water to provide a cleaned glassware.

Some embodiments of the present invention will now be described in detail in the following Examples.

Example S1

Synthesis of Oxidized Maltodextrin

To a round bottom flask was added 60 mL of deionized water, 10.0 g of maltodextrin (Dextrose Equivalent, DE, of 16.5-19.5), 0.95 g of sodium bromide, and 0.096 g of 2,2,6,6-tetramethylpiperidine-1-oxyl (TEMPO). The flask contents were cooled to ~4° C. by placing the flask in an ice bath and a sodium hypochlorite solution (84 mL, 13% aqueous solution) was added to the cooled flask contents over the course of 30 min while maintaining the pH at 9.5 through addition of 2 M NaOH solution. The contents of the flask gradually warmed to room temperature as the ice bath melted and after a total of 24 hr, the product was precipitated by the addition of 500 mL EtOH with vigorous stirring. The precipitate was allowed to settle and the liquid was removed by decanting. An additional portion of 200 mL of EtOH was added to the precipitate and then removed by decanting off. The solid was dried at 40° under vacuum.

Example S2

Synthesis of Oxidized Maltodextrin

To a round bottom glass flask was added 60 g of deionized water, 10 g of maltodextrin (Dextrose Equivalent, DE, of 4-7), 0.947 g of sodium bromide and 0.098 g of 2,2,6,6-tetramethylpiperidinyloxy or 2,2,6,6-tetramethylpiperidine-1-oxyl (TEMPO). The pH of the flask contents was then adjusted to 9.5 through the addition of 1.5 M NaOH. The flask contents were then mixed and cooled to ~4° C. by placing the flask in an ice bath. A sodium hypochlorite solution (76 mL, 13% aqueous solution) was pH adjusted to 9.5 with 5% HCl solution and then added to the cooled flask contents with stirring at 2 mL/min. The pH of the solution was maintained between 9.3 and 9.7 through the addition of 1.5 M NaOH solution. After addition of the sodium hypochlorite solution, the flask contents gradually warmed to room temperature as the ice bath melted and after 24 hr, the product was precipitated from the flask contents through the addition of 350 mL of ethanol with vigorous stirring. The precipitate was allowed to settle and the liquid was decanted from the flask. The sticky precipitate was scraped from walls, resuspended in 50 mL of ethanol, and stirred vigorously until a finely divided suspension was obtained. The solids were allowed to settle and the liquid was removed by decanting. The solids were then dried at room temperature under flowing nitrogen to provide the product oxidized maltodextrin.

Example S3

Synthesis of Oxidized Maltodextrin

To a round bottom glass flask was added 220 g of deionized water, 37 g of maltodextrin (Dextrose Equivalent, DE, of 16.5-19.5), 3.502 g of sodium bromide and 0.355 g of 2,2,6,6-tetramethylpiperidinyloxy or 2,2,6,6-tetramethylpiperidine-1-oxyl (TEMPO). The pH of the flask contents was then adjusted to 9.5 through the addition of 1.5 M NaOH. The flask contents were then mixed and cooled to ~4° C. by placing the flask in an ice bath. A sodium hypochlorite solution (248 mL, 13% aqueous solution) was pH adjusted to 9.5 with 5% HCl solution and then added to the cooled flask contents with stirring at 2 mL/min. The pH of the solution was maintained between 9.3 and 9.7 through the addition of 1.5 M NaOH solution. After addition of the sodium hypochlorite solution, the flask contents gradually warmed to room temperature as the ice bath melted and after 24 hr, the product was precipitated from the flask contents through the addition of 1.4 L of ethanol with vigorous stirring. The precipitate was allowed to settle and the liquid was decanted from the flask. The precipitate was resuspended in 150 mL of ethanol and stirred vigorously until a finely divided suspension was obtained. The solids were allowed to settle and the liquid was removed by decanting. The solids were then dried at room temperature under flowing nitrogen to provide the product oxidized maltodextrin.

Example S4

Synthesis of Oxidized Maltodextrin

To a round bottom glass flask was added 360 g of deionized water, 60 g of maltodextrin (Dextrose Equivalent, DE, of 16.5-19.5), 5.68 g of sodium bromide and 0.58 g of 2,2,6,6-tetramethylpiperidinyloxy or 2,2,6,6-tetramethylpiperidine-1-oxyl (TEMPO). The pH of the flask contents was then adjusted to 9.5 through the addition of 1.5 M NaOH. The flask contents were then mixed and cooled to ~4° C. by placing the flask in an ice bath. A sodium hypochlorite solution (414 mL, 13% aqueous solution) was pH adjusted to 9.5 with 5% HCl solution and then added to the cooled flask contents with stirring at 4 mL/min. The pH of the solution was maintained between 9.3 and 9.7 through the addition of 1.5 M NaOH solution. After sodium hypochlorite solution addition, the flask contents gradually warmed to room temperature as the ice bath melted and after 24 hr, the product was precipitated from the flask contents through the addition of 2.0 L of ethanol with vigorous stirring. The precipitate was allowed to settle and the liquid was decanted from the flask. The sticky precipitate was scraped from walls, resuspended in 200 mL of ethanol and stirred vigorously until a finely divided suspension was obtained. The solids were allowed to settle and the liquid was removed by decanting. The solids were then dried at room temperature under flowing nitrogen to provide the product oxidized maltodextrin.

Oxidized Maltodextrin Characterization

Quantitative $^{13}C$ NMR was used to measure the degree of oxidation (DO) and the mol % oxidation for oxidized maltodextrin prepared according to each of Examples S1-S4, as reported in TABLE 1. Specifically, a 0.3 g sample of the oxidized maltodextrin was dissolved in 2.5 mL of heavy water ($D_2O$) at room temperature in a 10 mm NMR tube. Inverse-gated $^{13}C$ NMR experiments were performed at room temperature with 90° single pulse on a Bruker Avance II NMR spectrometer equipped with a 10 mm C/H cryogenic probe. The relaxation time was set to 30 s and 4,000 scans of data were taken for each spectrum. Three groups of peaks were integrated: L is the intensity of carbonyl signals in the chemical shift range of 180-170 ppm which is the total amount of oxidation, $I_b$ is the intensity of unreacted carbon 6. The exact peaks to be integrated were determined by DEPT-135 NMR experiment and are typically in the chemical shift range of 58-64 ppm. $I_c$ is the total intensity of all carbons in maltodextrin from 180 to 58 ppm in chemical shift. The following equations were used to calculate DO and mol % of oxidation:

$$DO=(6*I_a)/I_c$$

$$C6 \text{ mol \% oxidation}=\{1-[(6*I_b)/I_c]\}*100\%$$

$$C2,C3 \text{ mol \% oxidation}=\{[3*(I_a+I_b)/I_c]-0.5\}*100\%$$

TABLE 1

| Ex | DO | weight average molecular weight, $M_w$, (Daltons) | Mol % oxidation C6 | Mol % oxidation C2, C3 |
|---|---|---|---|---|
| S1 | 1.40 | 5,400 | 93 | 23.5 |
| S2 | 0.85 | 11,600 | — | — |
| S3 | 0.67 | 4,000 | 56 | 5.5 |
| S4 | 0.48 | 2,870 | 41 | 3.5 |

Procedure for Preparing Food Soil

The modified STIWA food soil described in TABLE 2 was prepared by the following procedure.

a) Bringing the water to a boil.

b) Mixing in a paper cup the instant gravy, the benzoic acid and the starch; and then adding the mixture to the boiling water.

c) Adding the milk and margarine to the product of (b).

d) Letting the product of (c) cool down to approximately 40° C., and then adding mixture to a kitchen mixer (Polytron).

e) Combining in another paper cup, the egg yolk, the ketchup and the mustard and mixing with a spoon.

f) Adding the product of (e) to the mixture of (d) in the blender with continuous stirring.

g) Letting the product of (f) stir in the blender for 5 minutes.

h) The freezing the product food soil mixture from 7.

i) The frozen slush is placed into the dishwasher at the time indicated below.

TABLE 2

| Ingredient | Weight, g |
|---|---|
| Water | 700 |
| Margarine | 100 |
| Gravy Powder | 25 |
| Potato Starch | 5 |
| Benzoic Acid | 1 |
| Egg Yolk | 3 |
| Mustard | 25 |
| Ketchup | 25 |
| Milk | 50 |

Comparative Examples DC1-DC3 and Examples D1-D2

Dishwashing Compositions

Anhydrous dishwashing compositions were prepared in each of Comparative Examples DC1-DC3 and Examples D1-D2 having the component formulations identified in TABLE 3. The protease used in each of the component formulations was Savinase® 12T protease available from Novozymes. The amylase used in each of the component formulations was Stainzyme® 12T amylase available from Novozymes.

TABLE 3

| | Concentration on solids basis (wt %) | | | | |
|---|---|---|---|---|---|
| Ingredient | DC1 | DC2 | DC3 | D1 | D2 |
| Sodium Citrate | 20 | 20 | 20 | 20 | 20 |
| Sodium Carbonate | 30 | 30 | 30 | 30 | 30 |
| Percarbonate | 15 | 15 | 15 | 15 | 15 |
| TAED | 4 | 4 | 4 | 4 | 4 |
| MGDA | 10 | 10 | 10 | 10 | 10 |
| Sodium Sulfate | 9 | 9 | 9 | 9 | 9 |
| Nonionic Surfactant[a] | 5 | 5 | 5 | 5 | 5 |
| HEDP[b] | 0.5 | 0.5 | 0.5 | 0.5 | 0.5 |
| Amylase | 1 | 1 | 1 | 1 | 1 |
| Protease | 2 | 2 | 2 | 2 | 2 |
| Dispersant Polymer[c] | 3.5 | — | — | — | — |
| Dispersant Polymer[d] | — | 3.5 | — | — | — |
| Dispersant Polymer[e] | — | — | 3.5 | — | — |
| Example S1 | — | — | — | 3.5 | — |
| Example S4 | — | — | — | — | 3.5 |

[a]Dowfax ™ 20B102 nonionic linear alcohol alkoxylate available from The Dow Chemical Company.

[b]Dequest ™ 2010 DequestTM 2010 organophosphonate available from Italmatch Chemicals S.p.A.

[c]Acusol ™ 445N polyacrylic acid dispersant available from The Dow Chemical Company.

[d]Acusol ™ 588 dispersant (polyacrylate copolymer) available from The Dow Chemical Company

[e]Baypure DS100 polyaspartic acid available from Lanxess

Dishwashing Test Conditions

Machine: Miele SS-ADW, Model G1222SC Labor. Program: 1 at 60° C. wash cycle with heated wash for 8 min, fuzzy logic disengaged, heated dry. Water: 375 ppm hardness (as $CaCO_3$, confirmed by EDTA titration), Ca:Mg=3:1. Food soil: 50 g of the composition noted in TABLE 2 was introduced to the wash liquor at t=15 minutes frozen in a cup. Each dishwashing composition from Comparative Examples DC1-DC3 and Examples D1-D2 were tested, dosed at 20 g per wash.

Filming and Spotting Evaluation

After 15 wash cycles under the above dishwashing test conditions, the glass tumblers were dried in open air. After drying in open air filming ratings were determined by trained evaluators by observations of glass tumblers in a light box with controlled illumination from below. Glass tumblers were rated for filming and spotting according to ASTM method ranging from 1 (no film) to 5 (heavily filmed). An average value of 1 to 5 for filming was determined for each glass tumbler and are reported in TABLE 4.

TABLE 4

| Dishwashing Composition | Filming (20 Cycles) | Filming (15 Cycles) |
|---|---|---|
| Comp. Example DC1 | 2 | 1.5 |
| Comp. Example DC2 | 2 | — |
| Comp. Example DC3 | 4.25 | 3.25 |
| Example D1 | — | 1.75 |
| Example D2 | 2 | — |

We claim:

1. A method of washing glassware, comprising:

providing an automatic dishwashing apparatus;

providing soiled glassware;

placing the soiled glassware in the automatic dishwashing apparatus;

providing a wash water;

providing a rinse water;

selecting an anhydrous mixed powder or mixed granule consisting of:

2.5 to 5 wt % of oxidized maltodextrin, wherein the oxidized maltodextrin has a Degree of Oxidation, DO, of 0.4 to 1.7;

10 to 25 wt % of an amino acid based builder, selected from the group consisting of nitrilotriacetic acid; ethylenediaminetetraacetic acid; diethylenetriaminepentaacetic acid; glycine-N,N-diacetic acid; methyl glycine-N,N-diacetic acid; 2-hydroxyethyliminodiacetic acid; glutamic acid-N,N-diacetic acid; 3-hydroxy-2,2'-imonodissuccinate; S,S-ethylenediaminedisuccinate aspartic acid-diacetic acid; N,N'-ethylene diamine disuccinic acid; iminodisuccinic acid; aspartic acid; aspartic acid-N,N-diacetic acid; beta-alaninediacetic acid; polyaspartic acid; salts thereof and mixtures thereof;

20 to 75 wt % of an additional builder, wherein the additional builder is at least one of sodium citrate, sodium carbonate and sodium percarbonate;

2.5 to 7.5 wt % of a bleach activator, wherein the bleach activator is tetraacetylethylenediamine;

0.5 to 10 wt % of a surfactant, wherein the surfactant is a nonionic surfactant;

0.5 to 1 wt % of a phosphonate;

1 to 6 wt % of an enzyme, wherein the enzyme is a mixture of a protease and an amylase;

5 to 15 wt % of a filler, wherein the filler is sodium sulfate;

<1 wt % water; and optionally, an additive selected from the group consisting of an alkaline source, a bleaching agent, a bleach catalyst, a foam suppressant, a coloring agent, a fragrance, a silicate, an antibacterial agent, a filler and mixtures thereof;

placing the selected anhydrous mixed powder or mixed granule in the automatic dishwashing apparatus;

contacting the selected anhydrous mixed powder or mixed granule with the wash water to form a combination;

contacting the soiled glassware with the combination to provide a treated glassware; and then contacting the treated glassware with the rinse water to provide a cleaned glassware.

2. The method of washing glassware according to claim 1, wherein the oxidized maltodextrin has a weight average molecular weight of 2,500 to 6,000 Daltons.

3. The method of washing glassware according to claim 2, wherein at least 60 mol % of the C6 carbons in the oxidized maltodextrin have been oxidized to a carboxyl group.

4. The method of washing glassware according to claim 3, wherein less than 30 mol % of the C2 and C3 carbons in the oxidized maltodextrin have been oxidized to a carboxyl group.

5. The method of washing glassware according to claim 4, wherein the oxidized maltodextrin has ≥0.0001 wt % of at least one of 2,2,6,6-tetramethylpiperidinyloxy or 2,2,6,6-tetramethylpiperidine-1-oxyl.

6. The method of claim 1, wherein the alkaline source is selected from the group consisting of an alkali metal carbonate, and alkali metal hydroxide and mixtures thereof;

wherein the bleaching agent is selected from the group consisting of sodium percarbonate, sodium perborate and mixtures thereof; and wherein the bleach catalyst is selected from the group consisting of manganese(II) acetate, cobalt(II) chloride, bis(TACN)magnesium trioxide diacetate and mixtures thereof.

7. The method of claim 2, wherein the alkaline source is selected from the group consisting of an alkali metal carbonate, and alkali metal hydroxide and mixtures thereof;

wherein the bleaching agent is selected from the group consisting of sodium percarbonate, sodium perborate and mixtures thereof; and wherein the bleach catalyst is selected from the group consisting of manganese(II) acetate, cobalt(II) chloride, bis(TACN)magnesium trioxide diacetate and mixtures thereof.

8. The method of claim 3, wherein the alkaline source is selected from the group consisting of an alkali metal carbonate, and alkali metal hydroxide and mixtures thereof;

wherein the bleaching agent is selected from the group consisting of sodium percarbonate, sodium perborate and mixtures thereof; and wherein the bleach catalyst is selected from the group consisting of manganese(II) acetate, cobalt(II) chloride, bis(TACN)magnesium trioxide diacetate and mixtures thereof.

9. The method of claim 4, wherein the alkaline source is selected from the group consisting of an alkali metal carbonate, and alkali metal hydroxide and mixtures thereof;

wherein the bleaching agent is selected from the group consisting of sodium percarbonate, sodium perborate and mixtures thereof; and wherein the bleach catalyst is selected from the group consisting of manganese(II) acetate, cobalt(II) chloride, bis(TACN)magnesium trioxide diacetate and mixtures thereof.

10. The method of claim 5, wherein the alkaline source is selected from the group consisting of an alkali metal carbonate, and alkali metal hydroxide and mixtures thereof;

wherein the bleaching agent is selected from the group consisting of sodium percarbonate, sodium perborate and mixtures thereof; and wherein the bleach catalyst is selected from the group consisting of manganese(II) acetate, cobalt(II) chloride, bis(TACN)magnesium trioxide diacetate and mixtures thereof.

* * * * *